US007555985B2

(12) United States Patent
Loddenkoetter

(10) Patent No.: US 7,555,985 B2
(45) Date of Patent: Jul. 7, 2009

(54) PRE-REGISTER ADJUSTMENT

(75) Inventor: Manfred Loddenkoetter, Ibbenbueren (DE)

(73) Assignee: Windmoeller & Hoelscher KG, Lengerich (DE)

( * ) Notice: Subject to any disclaimer, the term of this patent is extended or adjusted under 35 U.S.C. 154(b) by 510 days.

(21) Appl. No.: 10/535,910

(22) PCT Filed: Nov. 12, 2003

(86) PCT No.: PCT/EP03/12865

§ 371 (c)(1),
(2), (4) Date: Jan. 27, 2006

(87) PCT Pub. No.: WO2004/048093

PCT Pub. Date: Jun. 10, 2004

(65) Prior Publication Data

US 2006/0150852 A1 Jul. 13, 2006

(30) Foreign Application Priority Data

Nov. 22, 2002 (DE) ..... 102 54 836

(51) Int. Cl.

| | |
|---|---|
| ***B41F 33/00*** | (2006.01) |
| ***B41F 13/02*** | (2006.01) |
| ***B41F 1/54*** | (2006.01) |
| ***B41F 1/66*** | (2006.01) |
| ***B41L 3/02*** | (2006.01) |
| ***B41L 3/08*** | (2006.01) |
| ***B41L 5/12*** | (2006.01) |
| ***B41L 39/00*** | (2006.01) |
| ***B41L 47/56*** | (2006.01) |
| *B65H 23/00* | (2006.01) |
| *B65H 23/18* | (2006.01) |

(52) U.S. Cl. ..... 101/486; 101/484; 226/2; 226/28

(58) Field of Classification Search ..... 101/484, 101/485, 486; 226/2, 28
See application file for complete search history.

(56) References Cited

U.S. PATENT DOCUMENTS 3,701,464 A * 10/1972 Crum ..... 226/3
4,391,190 A 7/1983 Metzler (Continued)

FOREIGN PATENT DOCUMENTS

DE 101 45 957 A1 10/2002

(Continued)

*Primary Examiner*—Anthony H Nguyen
*Assistant Examiner*—Leo T Hinze
(74) *Attorney, Agent, or Firm*—Jacobson Holman PLLC

(57) ABSTRACT

A method for pre-registration in a printing machine with multiple printing units in which phases of the printing cylinders involved in the printing process are so mutually attuned that the deviations of the printing images of the different printing cylinders lie within mutual capture areas, includes using the deviations in the context of the registration of an ongoing printing operation, respectively, for the determination of the position of the printing images or parts thereof. The web to be printed, which is fed during the pre-registration to the printing machine, has at least one mark, which passes through different printing units during the pre-registration. The time points at which the mark passes the measuring points in the printing units are recorded, and these time points are set with reference to the angular position of the printing images of the respective printing units at those time points.

12 Claims, 1 Drawing Sheet

U.S. PATENT DOCUMENTS

| | | | | |
|---|---|---|---|---|
| 4,528,630 | A * | 7/1985 | Sargent | 700/125 |
| 6,499,397 | B2 * | 12/2002 | Stern | 101/248 |
| 6,634,297 | B2 | 10/2003 | Poetter et al. | |
| 6,782,814 | B2 * | 8/2004 | Tokiwa | 101/211 |
| 2001/0022143 | A1 | 9/2001 | Stern | |

FOREIGN PATENT DOCUMENTS

| | | | |
|---|---|---|---|
| DE | 102 54 836 | A1 | 6/2004 |
| EP | 0 023 299 | | 2/1981 |
| EP | 0 993 947 | B1 | 4/2000 |
| WO | WO 2004/048093 | A3 | 6/2004 |

* cited by examiner

PRE-REGISTER ADJUSTMENT

BACKGROUND OF THE INVENTION

1. Field of Invention

The invention relates to a process for pre-register setting in a printing machine with multiple printing units.

2. Description of the Prior Art

For multicolor printing, printing machines—and here in particular, gravure printing machines—apply individual colors in individual printing units. In the printing process, the positions of the images with the different colors with respect to each other are checked by means of register controls. For that purpose, the register marks are in general recorded and their distances are kept constant.

This type of register methods are discussed, among others, in the hitherto unpublished German patent application with the application number 102 54 836. Before the printing process starts, and before these controls are used, the printed images must be mutually so aligned that the register marks lie within the capture area of the used measuring system of the regulator (pre-register setting). For that, the phasing of the cylinder and/or the web length between the printing units is adjusted. The effective sheet length of the webs between the printing units is in general not an integral multiple of the printing length.

As a rule, the pre-registering takes place during the preparation of the press. The printing length varies according to the motif and the anticipated web extensions. The effective web length between the printing units varies due to the selected path of the web, due to the different sizes of the printing cylinders and the impression roller, due to the mechanical flexibility and the tolerances, due to process parameters like the web tension and the drying temperature, as well as due to physical properties of the printing material, such as its modulus of elasticity and its geometrical dimensions.

The pre-register setting is done according to the state of the art for the printing job, for which the preparations are done for the first time, in general manually. The print images are printed at random positions on the web. In stationary machines, the position deviation is then determined through length measures. This data is entered as correction values in the machine regulation, which determines and sets the phase displacement based on it. In a reapplied contact pressure, the printed images then overlap to a large extent. The required time and the quantity of the discards are a disadvantage in this method.

Automated pre-register settings require entry of the web length as the basis for the calculations for the phase of the cylinder in the preparations for the first time. However, the effective web length varies much, especially in case of flexible printing substrates, due to the variations in the length of the material, so that the capture area is in general missed and the process is therefore employed only seldom. Thereby, the tolerance in the alignment of the printing cylinder with the rotation angle receiver of the drive also proves to be problematic.

A pre-register setting for a repetitive application can be based on stored information about the phasing of the printing cylinder for the original application. However, this process requires otherwise also exact repetition of all process and machine parameters (even the ambient temperature and the humidity) and has consequently been less successful in general.

SUMMARY OF THE INVENTION

Thus, the object of the present invention is to propose a more successful pre-register process that is capable of fast performance.

This problem is solved according to the embodiments of the invention described herein.

In a preferred embodiment of the process according to the invention, the phasing of the cylinder undergoes automatic mutual adjustment. For that purpose, the web is marked before the first printing unit. The marks go along with the web, under any arbitrary process conditions, in course of the printing operation through all printing units, which have random phasing. The mark is identified by the position in each printing unit and the phasing of the associated printing cylinder is determined in isochronous manner.

The first cylinder forms the desired phase of the print mark, other cylinders show deviating phases at the time of the arrival of the mark. Through lifting of the impression cylinder for a short moment with immediate phase adjustment of the cylinder according to the detected phase deviation, and its lowering again, the print images superimpose after the passage of the mark.

However, it is also conceivable to first save the information about the relative angular position of the printing cylinder for marking the web, gained by means of the method according to the invention, and to carry out the necessary settings for the pre-registration at a later point of time.

The mark is preferably an adhesive strip, which acts as a change in the web thickness at the print clearance between the printing cylinder and the impression roller and disturbs the transport of the web and the rotation of the print cylinder. This type of discontinuity/bulge leads in general to a change in the speed of the drive chain of the individually driven printing cylinders and as a result to deviation of the actual position from the desired position of the cylinder (lag error). Feedback circuits in the modern drives (with current, speed and position regulation circuits) compensate for this deviation through increase in the motor current, which leads to a higher driving torque. Thus, the measured variables, namely, the lag errors, position, speed, acceleration, motor current and torque at the time of the arrival of the mark at the printing clearance are characterized by a change in their sizes. An additional sensor is not necessary. Indirectly measured variables can be calculated.

The higher the pressure of the impression cylinder and the thicker, wider and harder the adhesive stripe, greater are the jumps in the measured variables. Due to the changes in the parameters of the drive control circuits, not only large torque jumps, but also large lag errors, can be the result.

Basically, an adhesive stripe can also be an adhesive joint between two webs.

The passage of an adhesive stripe through the printing clearance simply leads to a torque curve of the drive as shown in FIG. 1.

The first rise in the torque curve is suitable for the detection of the arrival of the mark as also the first maximum or the derived variables. Signal profiles in sequence of time are typically overlapped with transients.

The local resolution is determined through the quality of the signal rise and the scanning times of the drive feedback circuits, in combination with the speed of the webs.

The passage of such a mark (adhesive stripe/adhesive joint) can also be detected through a change in the tension of the web. This is particularly visible in case of solid printing substrates with high e-module. The lag error reduces the tension of the web for a short duration. In the run of the web, the rollers for measuring the web tension are integrated at diverse positions. In the modern machines, they are located at the front, rear and between the printing units.

If the requirements in regard to the positional accuracy and the speed of the web cannot be fulfilled adequately for an application, the mark can also be detected with an additional sensor.

The passage of a mark can be detected as follows:

The adhesive strip lifts the impression cylinder by about 1/10 mm.

A position encoder registers this alteration in the position (distance sensor, initiator, lag sensor, rotation angle transducer in differential gears . . . )

Besides the mechanical, optical and inductive sensors, let the possibility of capacitive detection be also mentioned here. For that, the change in the capacity between the earthed printing cylinder and the semi conducting impression cylinder (ESA) can be determined. An adapted adhesive mark can also lead to a change in the current or the voltage in the ESA circuit, which is then identified as the passage of the mark.

An acceleration sensor can detect the jerky lifting of the impression cylinder.

A pressure measurement device, which monitors the pressure of the impression cylinder, can detect the lifting of the impression cylinder.

An adhesive stripe on the backside of the printing material, which is in particular in color, is detectable with certainty also by a so-called color-sensor. Disadvantageous in a sensor mechanism outside the printing clearance are the errors in the assignment of the phases of the printing cylinder, for example, due to a different diameter of the impression cylinder. This error does not appear in case of the aforementioned process and is looked at as an advantage.

Further marks, like a perforation in the form of a hole in the web, are also thinkable in context of this application. Present web rupture sensors (optical/capacitive) or reflection sensors can also monitor these marks.

It is of particular advantage to use a method according to the invention for the rotogravure print and, there, in particular in the package rotogravure print, because, there are large web lengths between the individual color decks, which make the pre-registration especially complicated with the flexible materials frequently used in such cases.

Other illustrative instances of the embodiment according to the invention follow from the objective description and the claims.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
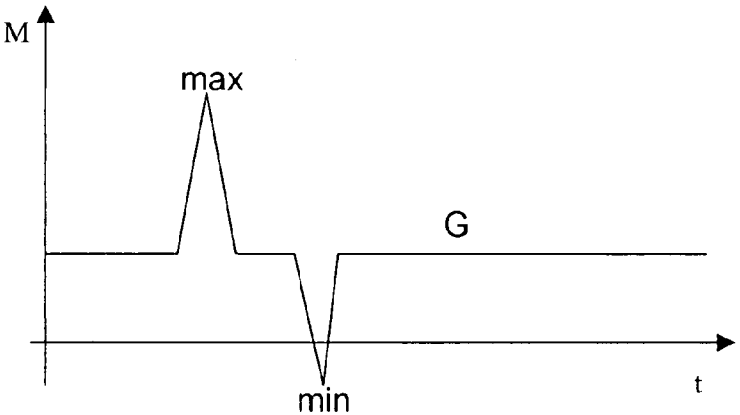
FIG. 1 The torque curve with the drive of a pressure roller and counter-impression cylinder during the passage of an embossed marking.

In FIG. 1, the graph G shows an exemplary profile of the torque M against time t.

The torque exerted by the drive forming, at least one of the two roller clearance drives, reaches its relative discrete maximum value max with the arrival of the embossed mark. When the marking leaves the roller clearance, a minimal torque is applied—the torque curve reaches its minimum.

Figure 2:
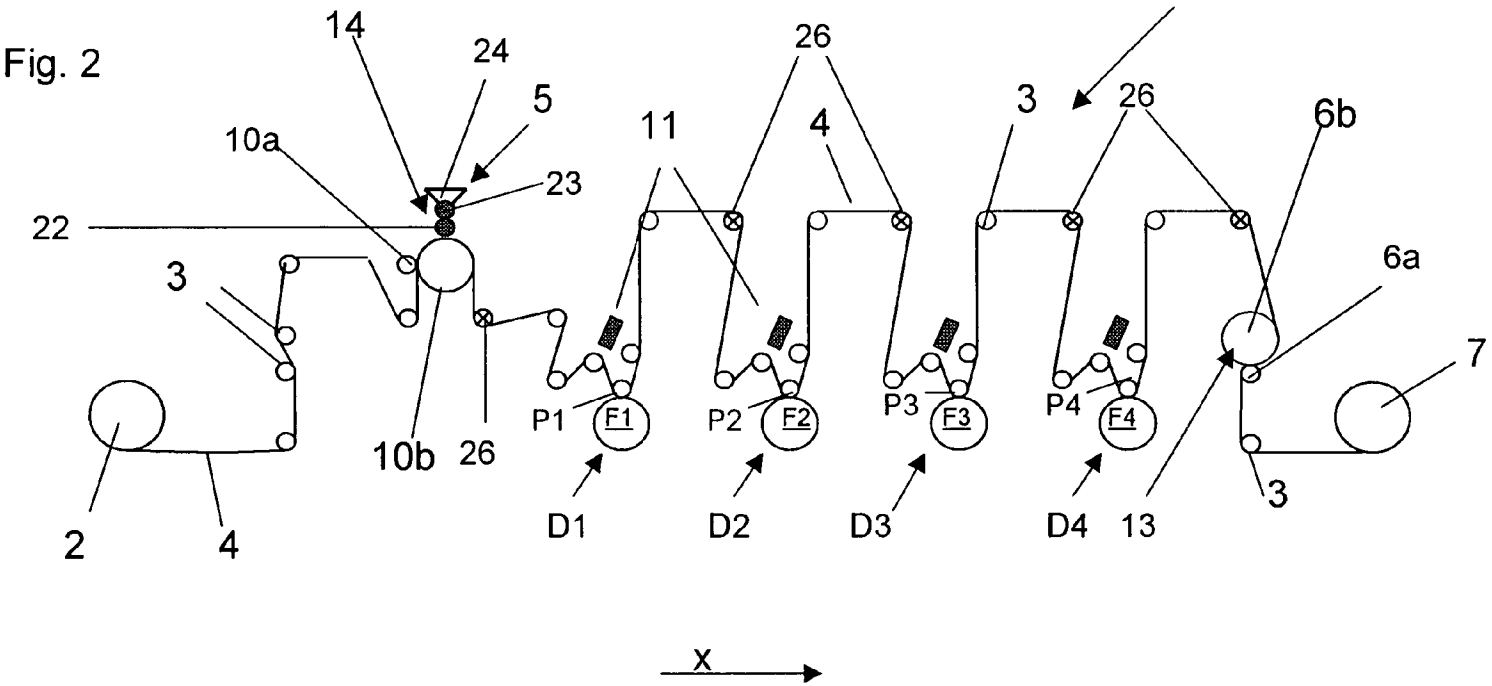
FIG. 2 A view of a gravure printing press

FIG. 2 shows a sketch of a side view of a serial gravure printing press 1, which is provided with the pre-register settings according the invention. Shown are the four color decks F1 to F4, of which only the impression rollers P1 to P4, and the print rollers D1 to D4, are shown. As mentioned, the rotogravure press is equipped with an embodiment of the pre-register settings according to the invention. The exact design of the rotogravure press, not according to the invention, such as its equipment with only four color decks—which are inadequate for the modern package print—has only a exemplary character here.

During the printing process, the printing substrate 4 is unwound from the winding or the reserve roll 2 and is fed at first through the guide roll 3 to the draw unit 14, of which the 14, the press roller 10*a* and the drawing unit roller 10*b* are shown here in a stylized fashion. Besides that, the drawing unit 14 includes a drawing print unit 5, which is built in this case—for example—as a flexographic press. As a result, the format cylinder 22 and the engraved roller 23 and the doctor blade chamber 24 are shown as the constituents of the drawing press unit.

To carry out the processes according to the invention, however, other printing units, automatic or manual etiquette device or even punching devices are also suitable. Even the place at which this "pre-marking" is done in the web is also arbitrary.

The drawing press unit makes a web marking, not shown here, on the printing material web 4.

The material web 4 is fed through the sensor roller 26, which measures the sheet tension, and feeds the diverse guide rolls 3 to the printing units D1 to D4 and is printed on. Since it has to do in case of the shown printing machine 1 with a serial rotogravure press, in which the invention can be used especially well, these printing units D1 to D4 consist of impression cylinders P1 to P4 and format cylinders F1 to F4, which are also called print rollers for the purpose of this patent application. For the determination of the position of the marking, sensors 11 are installed before the respective color decks F1 to F4, in the direction of the transport of the printing material web 4. These sensors 11 transmit the time point to the counter unit, not shown here, at which the marking passes the respective sensed positions.

Other preferred instances of the embodiments according to the invention resort in this context to other sensors. Thus, among other things, compared to the printing material 4, the embossed markings can be detected more exactly, if these markings pass the roller clearance, where the printing process takes place. For that, the torque curve of the roller drives can be monitored. Of course, the action of the force of the marking on the rollers, or the position change resulting from the action of this force, can also be measured by means of appropriate sensors.

A counter unit determines according to the invention the difference between the angular positions of the various cylinders at this point of time, when at least one mark passes the corresponding printing unit. Following that, the correction signals are generated, which set the relative angular positions of the printing rollers and/or the web path between the different printing units. The latter can take place, in case of the shown machine for example, through alteration of the position of the guide rolls 3.

In case of FIG. 2, display of the shaft encoders or other position measuring devices is omitted, because it is known, for instance, how the more recent directly driven machines are equipped with these sensors. For example, in DE 101 45 957 A1, a number of the actuating mechanisms and drives are described, which play a role in printing machines—in the named case, a central cylinder flexographic press. In the mentioned application, it is also described how the actuating elements can be connected with a regulating device. In modern directly driven machines, the drives are often directly networked with regulator devices, which include counter units. Therefore, at this point, the graphical presentation of the regulator and counter units as well as of their connection with the actuators of the printing machines can be dispensed with.

What remains to be mentioned, is that the printed printing material is fed, in the familiar manner, through the guide rolls 3 to the drawing unit 13, which consists of a contact pressure roller 6*a* and the drawing roller 6*b*. After that the printing material passes through the guide rolls 3 to the take-up 7, in which it winds up 4 and is stored.

In the present application, as the print clearance or the roller clearance, the clearance between any roller carrying a printed image and a counter-support is denoted. Thereby, let it be stressed, that a rubber blanket roller, which does not transport any printing plate, but only an impression of it, also carries a printing image in the sense of the present application. In illustrative embodiment shown in FIG. 2, the print clearance between the print rollers D1-D4 and the respective impression rollers P1-P4 are shown.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

List of Reference Symbols

| | |
|---|---|
| 1 | Printing machine/press |
| 2 | Storage roll |
| 3 | Guide roll |
| 4 | Printing material web |
| 5 | Drawing printing unit |
| 6a | Pressure roller |
| 6b | Draw-in roller |
| 7 | Take-up |
| 10a | Pressure roller |
| 10b | Take-up |
| 11 | Sensor |
| 13 | Draw-in |
| 14 | Draw-in |
| 22 | Format cylinder |
| 23 | Engraved roller |
| 24 | Doctor blade chamber |
| 26 | Sensor roller |
| D1-D4 | Pressure units |
| F1-F4 | Format cylinder |
| P1-P4 | Impression cylinders |
| Max | Maximum |
| Min | Minimum |
| G | Graph |
| M | Torque |
| T | Time |

What is claimed is:

1. A process for pre-registration in a printing machine with multiple printing units, in which phases of printing cylinders involved in the printing process are mutually attuned such that deviations of printing images of the various printing cylinders lie within a mutual capture area of a measuring system which is used in context of the registration during an ongoing printing operation respectively for determining the printing images or parts of the printing images, the process comprising:

feeding a web to be printed to the printing machine in the pre-registration, the web having at least one mark which passes various printing units during the pre-registration;

recording time points at which the marks pass measuring points in the printing units, the time points being set with reference to an angular position of the printing images of the respective printing units at the time points;

based thereon, adjusting at least one of drives of the printing cylinders and a web path between the printing units such that the deviations of the printing images of the different printing cylinders lie mutually within the capture area of the measuring system, and are used in a context of the registration during an ongoing printing operation respectively for the step of determining the printing images or the parts of the printing images, the time points being recorded at a point at which the print mark passes the roller clearance, and the mark being embossed, compared to the printing material, on at least one surface of the web; and recording an action of a force, which is applied during the passage of the mark through the roller clearance, on the printing cylinders or a counter-support therefor, or a change in a position or an acceleration of at least one of the print cylinders and the counter-supports therefor, or derived mechanical parameters associated therewith.

2. The process according to claim 1, wherein the time points at which the mark passes the measuring points in the printing units and/or the angular position of the printing image at the points of time and/or the difference between the angular position of the different printing images at the time point, at which the image passes at least one mark of the corresponding printing unit is made visible with a display device and a machine operator sets, based on the displayed information, the drives of the printing cylinder and/or the path of the web between the printing units.

3. The process according to claim 2, wherein the time points at which the mark passes the measuring points in the printing units and/or the angular position of the printing images at the point of time are made visible by a display device and a counter unit calculates the difference between the angular position of the different printing images at the time point, at which at least one mark passes the respective printing unit, and adjusts the drives of the printing cylinders and/or the web path between the printing units.

4. The process according to claim 1, further comprising recording a change of torque (M) which a drive exerts on the roller adjacent to the print clearance, as the mark passes through the print clearance.

5. The process according to claim 4, further comprising, for the recording of the torque change (M), measuring a current of the drive which generates the torque of the printing cylinders, of the counter-supports, or another electrical quantity related to the current.

6. The process according to claim 5, wherein the electrical quantity related to the current that is measured is voltage.

7. The process according to claim 1, wherein a lag error of the drive of the printing cylinder or the counter-support is monitored and, based on a course thereof, the time point of the passage of the mark is determined.

8. The process according to claim 1, wherein during the pre-registration, the printing machine is loaded with a web to be printed which already carries the mark.

9. A printing machine comprising a pre-registration device for performing the process according to claim 1.

10. A process for pre-registration in a printing machine with multiple printing units, in which phases of printing cylinders involved in the printing process are mutually configured such that deviations of printing images of the various printing cylinders lie within a mutual capture area of a measuring system which is used in context of the registration during an ongoing printing operation respectively for determining the printing images or parts of the printing images, the process comprising:

feeding a web to be printed to the printing machine in the pre-registration, the web having at least one mark which passes various printing units during the pre-registration;

recording time points at which the marks pass measuring points in the printing units, the time points being set with reference to an angular position of the printing images of the respective printing units at the time points;

adjusting at least one of drives of the printing cylinders and a web path between the printing units such that the deviations of the printing images of the different printing cylinders lie mutually within the capture area of the measuring system, and are used in a context of the registration during an ongoing printing operation respectively for the step of determining the printing images or the parts of the printing images, the time points being recorded at a point at which the print mark passes the roller clearance, and the mark being embossed, compared to the printing material, on at least one surface of the web; and recording a change of torque (M) which a drive exerts on the roller adjacent to the print clearance, as the mark passes through the print clearance.

11. The process according to claim 10, further comprising, for the recording of the torque change (M), measuring a current of the drive which generates the torque of the printing cylinders, of the counter-supports, or another electrical quantity related to the current.

12. The process according to claim 10, further comprising recording an action of a force, which is applied during the passage of the mark through the roller clearance, on the printing cylinders or a counter-support therefor, or a change in a position or an acceleration of at least one of the print cylinders and the counter-supports therefor, or derived mechanical parameters associated therewith.

* * * * *